United States Patent [19]

Springer

[11] Patent Number: 4,539,280

[45] Date of Patent: Sep. 3, 1985

[54] METHOD FOR CREATING MAGNETIC TONER IMAGES HAVING CONTROLLED TONER DISTRIBUTION

[75] Inventor: Gilbert D. Springer, Sunnyvale, Calif.

[73] Assignee: Ferix Corporation, Fremont, Calif.

[21] Appl. No.: 581,868

[22] Filed: Feb. 21, 1984

[51] Int. Cl.[3] ..... G03G 19/00

[52] U.S. Cl. ..... 430/39; 430/110; 430/122; 346/74.2

[58] Field of Search ..... 430/39, 110, 122; 346/74.2

[56] References Cited

U.S. PATENT DOCUMENTS 4,111,823 9/1978 Kobayashi et al. ..... 430/110

4,323,929 4/1982 Nacci ..... 346/74.2

*Primary Examiner*—John L. Goodrow

*Attorney, Agent, or Firm*—Kolisch, Hartwell & Dickinson

[57] ABSTRACT

A method is presented for producing a controlled-distribution, toned magnetic image unit on a planar-like magnetic-image-storage medium having a magnetizable facial expanse using magnetically attractable toner particles having differing sizes. The method includes the steps of creating in such a facial expanse a latent magnetic image formed of magnetic vectors which extend generally parallel with the facial expanse adjacent the perimeter of the image and which extend with increasing angularity with respect to the facial expanse plane with distance inwardly from the perimeter; positioning the image sufficiently close to a mass of such particles to draw the particles magnetically to the latent image; and by said positioning and drawing, selectively capturing particles on the facial expanse extending over the latent image with the sizes of the captured particles generally tending to increase in size with distance inwardly from the perimeter of the image.

5 Claims, 5 Drawing Figures

FIG. 1
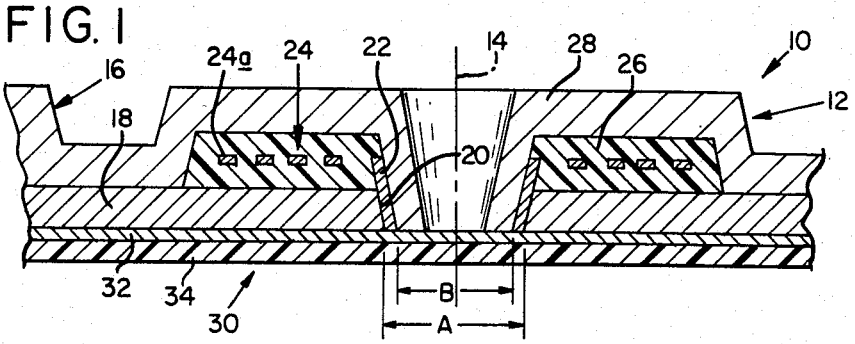
FIG. 2
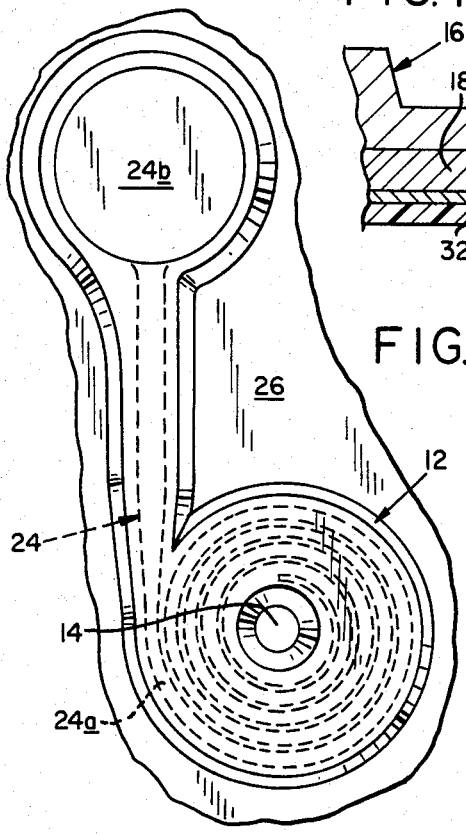
FIG. 3
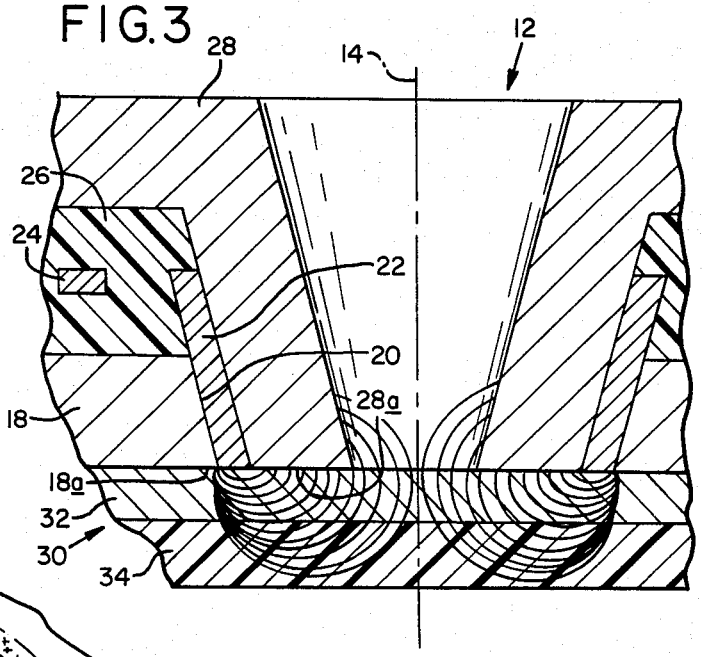
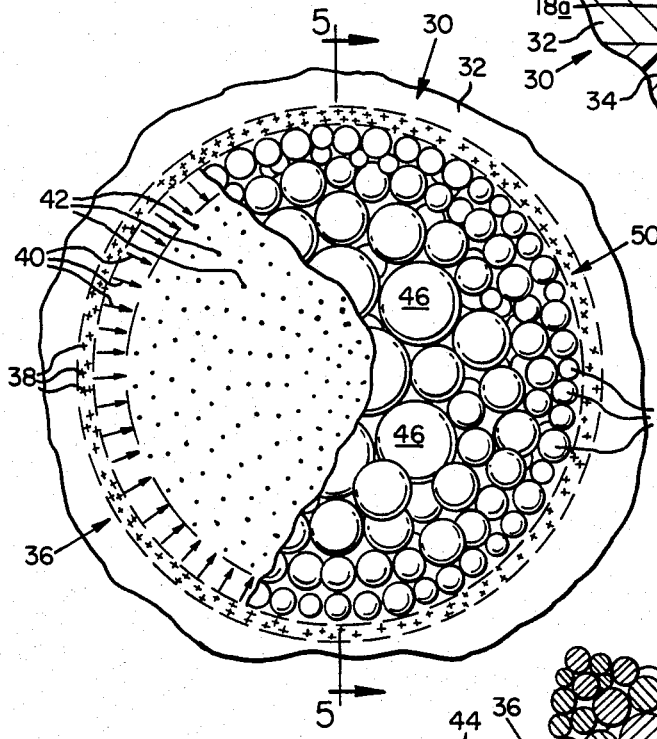
FIG. 4
FIG. 5
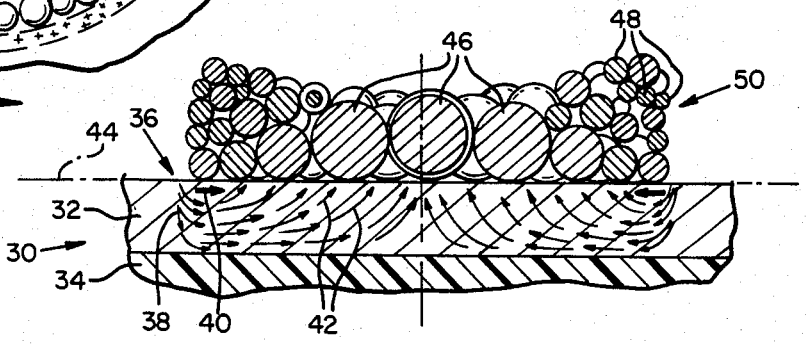

METHOD FOR CREATING MAGNETIC TONER IMAGES HAVING CONTROLLED TONER DISTRIBUTION

BACKGROUND AND SUMMARY OF THE INVENTION

This invention pertains to creating a magnetic image formed of toner particles having differing sizes. More specifically, it pertains to a method for creating such a magnetic image unit by forming a latent magnetic image having vectors distributed about the perimeter of a magnetizable facial expanse generally parallel to the plane of the expanse, the length of such vectors corresponding with particle fines.

The method of the present invention is particularly suited to be used in an electromagnetic printing system in which an electro-magnetic write head is used to generate latent magnetic images in a planar-like magnetic-image-storage medium having a magnetizable facial expanse. The latent magnetic image is then decorated with a mass of toner particles to form a toner image which is subsequently transferred to a toner-adherable medium, such as paper.

In such a system, as contemplated for use in practicing the instant invention, composite images are generated by placing combinations of individual toner image units in a desired configuration. It is highly desirable in such a system to create toned image units which have well-defined perimeters, so that when they are collectively formed in an overall image it also will have well-defined edges.

It is known in the art that toner tends to be attracted toward flux transitions in a magnetic medium. Conventional imaging, therefore, is typically based on a method of positioning adjacent opposite-flux-directed magnetic image units so that a flux transition is provided at their common boundary. This type of imaging, however, tends to produce inconsistent toning of the image units since a substantial portion of each image unit is not associated with a flux transition, and therefore only attracts limited amounts of toner.

It is therefore a desired object of the present invention to provide a method of creating a controlled-distribution, toned magnetic image unit on a facial expanse of a magnetic-image-storage medium.

In particular, it is an object of the present invention to provide such a method in which a toner population having particles of differing sizes is used to decorate the magnetic image unit such that fines predominate adjacent its outer perimeter.

It is also an object of the present invention to provide such an imaging method which produces a toned image unit having toner particle fines adjacent its perimeter and increasingly coarse particles toward a central region of the image unit.

The preferred method of practicing the instant invention includes the steps of creating in a magnetizable facial expanse a latent magnetic image having a generally circular configuration characterized by radially extending force vectors adjacent the image perimeter which generally lie in the plane of the expanse, the size of such vectors corresponding effectively to particle fines. Force vectors central in the image tend to be oblique relative to the plane of the expanse. This latent image is then decorated with a mass of such particles and by said decorating, and utilizing the forces associated with the radial and oblique vectors, capturing toner particles on the facial expanse extending over the latent image. The toner particle distribution resulting in this method provides for fines captured adjacent the perimeter of the image with increasingly coarse particles captured centrally in the image.

Each toned image unit produced by this method has well-defined edges and is generally completely toned. These and additional objects and advantages of the present invention will be more clearly understood from a consideration of the drawings and the following detailed description of the preferred method of practicing the present invention.

BRIEF DESCRIPTION OF THE DRAWINGS

FIG. 1 is a fragmentary axial cross-sectional view illustrating one embodiment of a writing head usable in practicing the present invention.

FIG. 2 is a reduced-scale view, taken from the point of view of the top side of FIG. 1, illustrating a conductive coil used in the writing head of FIG. 1.

FIG. 3 is an enlarged fragmentary view of the center of the writing head of FIG. 1, illustrating a magnetic flux line pattern which is created with the writing head energized adjacent a magnetic-image-storage medium.

FIG. 4 is a schematic, partially broken away, view of a toned, magnetized region (image unit) which is created in the magnetic-image-storage medium of FIG. 3.

FIG. 5 is a cross-sectional view of the latent and toned magnetic image units of FIG. 4 taken along line 5—5.

DETAILED DESCRIPTION OF THE INVENTION

Describing now an apparatus usable in practicing the preferred method of the present invention, direction should be directed to FIG. 1. Indicated generally at 10 is a magnetic writing-head structure including a plurality of writing heads, such as head 12. These heads are generally structurally similar to that which is illustrated in FIGS. 5 and 6 in my U.S. Pat. No. 4,414,554, issued Nov. 8, 1983, entitled "Magnetic Imaging Apparatus", and particularly as disclosed in my prior-filed U.S. Pat. application entitled "Differential-Permeability Field Concentrating Magnetic Writing Head", Ser. No. 381,922, filed May 26, 1982. Each head has what might be thought of as a pancake-sandwich construction. When viewed from the point of view of the top side of FIG. 1, such as in FIG. 2, the heads have a generally circular outline. The central axis of head 12 is shown at 14. One of a plurality of heads which are adjacent head 12 is shown fragmentarily at 16. Head 12 is representative of the construction of each other writing head in structure 10.

What might be thought of as the foundation carrier in structure 10 is a flexible web 18 formed of a suitable, high-permeability magnetic material which is also electrically conductive. Two materials which, for this purpose, have been found to be satisfactory are manufactured by Allied Chemical Company, and are sold under the designations 2826 MB Metglas ($Fe_{40}Ni_{38}Mo_4B_{18}$), and 2605 SE Metglas ($Fe_{81}B_{13.5}Si_{3.5}C_2$). Each of these two materials may obtain, through appropriate annealing procedures, a magnetic permeability of about 400,000 Henrys/meter.

Formed in web 18 and centered on axis 14 is a tapered aperture 20 which opens to both upper and lower faces of the web. The lower, smaller-diameter end of the aperture has a dimension, shown at A, of about 125-microns.

Formed within aperture 20, and distributed about the wall therein, is a copper collar 22. Collar 22, which functions as a diamagnetic material between pole faces in head 12, extends above the top surface of web 18 in FIG. 1 (as can be seen), and has a wall thickness of about 10-microns. As a consequence, the diameter at the inside of the lower end of collar 22 in FIG. 1, represented at B, is about 105-microns.

As has already been mentioned, the material which makes up web 18, in addition to being a magnetic material, is also an electrically conductive material. Collar 22, in addition to functioning as a diamagnetic material which defines a low permeability gap between pole faces in head 12, also functions to make electrical contact with web 18. The reasons for such contact will be explained later.

Electrically contacting and surrounding the upper end of collar 22 in FIG. 1 is a current-carrying coil 24. Coil 24 includes a spiral winding 24*a* which is disposed substantially symmetrically about axis 14. As can be seen, winding 24*a* is substantially planar, and lies in a plane spaced somewhat above the top surface of web 18 in FIG. 1. The cross-sectional area of winding 24*a* is about 1-mil$^2$.

FIG. 2 provides a view along axis 14 toward the top side of coil 24. Here it can be seen that winding 24*a* makes, essentially, four turns about axis 14, and extends, then, tangentially a short distance away from axis 14 toward an exposed terminating pad 24*b*.

Returning attention to FIG. 1, winding 24*a* is embedded and supported in a layer 26 of a suitable dielectric material. The specific material which forms layer 26 in head 12 herein is a product manufactured by E.I. Du-Pont de Nemours & Co., sold under the name Pyralin. Another suitable product, also made by the same company, is sold under the designation PI-2555 Polyimid. Conventional cured photo-resist, in addition, is an appropriate material.

Completing a description of head structure 10, formed over the parts already described is a blanket 28 of a high-permeability but non-electrically conductive magnetic material which, in structure 10, takes the form of a nickel-iron compound. While the material making up blanket 28 has a relatively high permeability, this permeability is significantly lower, preferably by at least an order of magnitude, than the permeability of the material making up web 18. In head structure 10, the permeability of blanket 28 is about 1,000- to 2,000-Henrys/meter.

As can be seen, this blanket extends downwardly, in the central portion of the head, into the inside of collar 22. The portion of blanket 28 which fills collar 22 has a full circular bottom face, as shown in FIG. 1, which is flush with the bottom face of web 18. Blanket 28 defines the top portion of head 12 in FIG. 1, and where it overlies winding 24*a*, has a generally circular configuration with a diameter of about 40-mils. Blanket 28 is also distributed over all of the other writing heads in structure 10, and performs with respect to each other head, exactly in the same manner as it does with head 12. The regions of contact between the blanket and web 18 constitute magnetic connections. Web 18 serves, among other things, as a common electrical connection for all coils in structure 10.

The lower coplanar faces of web 18 and blanket 28 adjacent aperture 20 on each side of the exposed portion of collar 22 form an outer circular magnetic pole 18*a* and an inner magnetic pole 28*a*, respectively.

Head 12 herein is used, as will be explained, to produce different magnetized regions in the face of a generally sheet-like image-storage medium, such as the magnetic belt or magnetic-image-storage medium, shown fragmentarily at 30. Belt 30 is supported on a suitable conventional transport system, and is held with an upper facial expanse 32 therein in FIG. 1 in close proximity to the underside of head 12. Expanse 32 is formed of conventional magnetic recording medium such as what is known in the trade as gamma ferric oxide. This material is anisotropic with a predominant direction of magnetization in the plane of the facial expanse, which plane is parallel with the plane of the face of web 18. Expanse 32 is supported in belt 30 by a flexible backing 34. Although belt 30 is shown to be planar in the figures, it will be appreciated that it may be used in various structures which are not truly planar but which provide a gradual curvature which is planar-like. One such application, as particularly is contemplated in the practice of the method of this invention, is the use of such a belt on a rotating drum.

Head 12 and head structure 10, in general, are made using known thin-film construction techniques. One such technique is described in my prior-referenced patent.

Referring now to FIG. 3, the same in greatly enlarged form, illustrates the central base portion of head 12, and in particular, indicates this portion under a circumstance with the poles therein excited by virtue of current flow in coil 24. Shown emanating from the bottom facial expanses of the two poles are curvilinear lines which represent lines of magnetic flux generated by the head, displayed schematically in the plane of FIG. 3. Of particular importance to note is that these lines of flux are extremely densely packed from where they extend from web 18 immediately around the perimeter of the base of aperture 20, and are considerably less dense where they extend from the bottom face of blanket 28. The flux lines are shown to travel in belt 30, including in some cases down through facial expanse 32 and into flexible backing 34. It is significant that at outer pole 18*a* the flux lines are extremely concentrated and substantially vertical, as viewed in FIG. 3. Adjacent the lower face of collar 22 the flux lines are substantially horizontal. With increasing distance from the position of collar 22 inwardly toward axis 14 of head 12, it can be seen that the flux lines in expanse 32 become increasingly more vertical. The significance of this flux pattern will be described shortly.

With head 12 energized to produce magnetic flux as is illustrated in FIG. 3, the head creates, in the magnetizable layer in belt 30, a generally annular magnetized region (image unit), such as the region shown fragmentarily at 36 in FIG. 4. The figure has been drawn assuming that flux travel occurred from pole 18*a* to inner pole 28*a*. The region includes a highly concentrated, low strength vertical narrow outer perimeter of vertical vectors, such as vector 38. Just inside vectors 38 is a ring of radially directed generally horizontal, comparatively strong magnetic vectors, such as vector 40. These vectors have a length which corresponds with the width of collar 22. As was described earlier, this length is approximately 10-microns. Centrally inwardly of vectors 40 are a plurality of relatively sparsely populated vector points. These vectors, as exemplified by vector 42, illustrate the generally oblique orientation of the resulting magnetized vectors produced in expanse 32. As was the case with vectors 38, vectors 42 tend to be weak because of the anisotropic characteristics of expanse 32.

FIG. 5 also illustrates, in cross-sectional view, the magnetic vectors produced in expanse 32. The annular magnetized region 36 may also be considered a latent magnetic image which exists in belt 30.

Explaining the preferred method of producing a controlled-distribution, toned magnetic image unit, as envisioned by this invention, and referring to the five figures to describe the sequential steps in the method, a head 12 is energized adjacent magnetic belt 30 to create in facial expanse 32 a latent magnetic image exemplified by region 36 in FIGS. 4 and 5. As has been described, in region 36 there are substantially dominant horizontal vectors 40 around the perimeter of the region which extend generally parallel with the surface of the facial expanse. Oblique vectors extend with increased angularity with respect to the facial expanse plane with distance inwardly from the region's perimeter. The surface of expanse 32 shown by dash-dot line 44 may be considered to represent the plane of expanse 32.

In a typical operating situation, coil 24 is energized to produce a magneto-motive force of about 1-ampere-turn for about 1- to 10-microseconds. This, in the region of the perimeter of the base of aperture 20, produces a peak magnetic field intensity of about 1,000-oersteds, and in the central "valley" region encompassed by the perimeter a minimum field intensity of about 8-oersteds.

When an image unit, such as unit 36, is created by head 12 under these conditions, a typical recorded field intensity adjacent the perimeter of the unit is about 350-oersteds, and adjacent the center of the unit is nearly 0-oersteds.

Next, image unit 36 is positioned sufficiently close to a mass of magnetically attractable toner particles such as particles 46, 48 shown in FIGS. 4 and 5.

An important feature of the method of the present invention is that the population of toner particles be of known varying sizes. In the preferred method of practicing this invention, toner is used which has particles ranging in size from approximately 5-microns as a minimum to approximately 70-microns as a maximum. The particles in the lower end of the range of sizes are considered to be fines because of their relatively small size and the particles in the upper end of the range are typically called boulders because of their large, coarse particle size. Although the toner particles illustrated in FIGS. 4 and 5 are substantially oversized for the size of image unit 36 and do not show the relative magnitude of variations in sizes from fines to boulders, the general distribution of bolder population by size is illustrated.

The application of toner particles to image unit 36 is also referred to as decorating the image unit. In practicing the instant invention where belt 30 is disposed on a rotating drum, the surface of expanse 32, containing image unit 36, is rotated past a toner decorator system whereby a mass or population of toner particles are presented to the surface of the belt. The magnetic field existing in image unit 36 attracts the toner particles and holds them to it as the belt passes through the toner population. The resulting toner image, shown generally at 50 in FIGS. 4 and 5, represents the total toner subpopulation which remains attached to expanse 32.

Since toner particles are magnetizable, they are attracted to the magnetic fields. Further, however, there is a strong propensity of magnetic toner to be most strongly attracted to or adjacent a magnetic vector which corresponds in effective length to the effective diameter of the toner particle.

Thus, in the magnetic latent image unit 36, the ring of strong radially directed horizontal vectors 40 particularly attract toner particles which are close in effective diameter to its length. Thus, generally speaking, vectors 40 having a length of approximately 10-microns attracts toner particles which are slightly larger, on the average, than 10-microns. Slightly larger sized particles tend to be attracted due to the flairing of flux lines from the ends of the vectors. These particles are relatively quite small with regard to the overall toner population and are what may be considered to be fines. By accumulating a pile of toner fines around the perimeter of image unit 36 due to the relative strength of vectors 40, there is produced thereby perimetral image unit definition which is very sharp.

It has also been observed that there is a tendency to have particles attracted to image unit 36 having a distribution as illustrated particularly with reference to FIG. 5. That is, with increasing distance centrally from the perimetrally disposed fines, there is increasing particle size. Thus, the boulders tend to congregate toward the center of unit 36 with the image perimeter-defining fines disposed around the outer edge. One reason for this particular distribution, it is felt, is produced by the strength of the perimetral vectors 40 which draw the fines to it. Additionally, it is considered that the boulders are more strongly drawn to the relatively weak, more widely spaced vertical vectors which predominate adjacent the center of the image unit It can therefore be seen that by utilizing the forces associated with the radial and oblique vectors, toner particles are captured on the facial expanse which extend over the latent image to produce a controlled-distribution, captured-toner image. The toner particle distribution, progressing radially inwardly from the perimeter of the captured-toner image, ranges generally from fines to boulders It can be seen that the method which has just been described provides for the production of a toned magnetic image unit which has a controlled-toner particle distribution. In particular, it produces such a toned magnetic image unit which has fines captured around the perimeter of the image unit and has boulders disposed centrally. The fines give a well-defined perimetral outline to the image unit and the boulders tend to more readily fill in the central expanse associated with the image unit While a preferred method of practicing the invention has been described herein, it will be understood by those skilled in the art, that various changes may be made therein without departing from the spirit and scope of the invention as defined in the following claims.

It is claimed and desired to secure by Letters Patent:

1. A method for producing a controlled-distribution, toned magnetic image unit on a planar-like magnetic-image-storage medium having a magnetizable facial expanse using magnetically attractable toner particles having differing sizes, said method comprising creating in such a facial expanse a latent magnetic image formed of magnetic vectors extending generally parallel with the facial expanse adjacent the perimeter of the image when the same is viewed normal to the plane of the expanse, and which extend with increased angularity with respect to the facial expanse plane with distance inwardly from the image's perimeter, positioning such image sufficiently close to a mass of such particles thereby to draw particles magnetically to the latent image, and by said positioning and drawing, selectively capturing particles on the facial expanse extending over the latent image, with the sizes of such captured particles generally tending to increase in size with the distance inwardly from the perimeter of the image.

2. A method of producing a controlled-distribution, toned magnetic image unit in a planar-like magnetic-image-storage medium having a magnetizable facial expanse using magnetically attractable toner particles having differing sizes existing generally within a range of sizes, including, at one end of the range, fines, said method comprising creating in such a facial expanse a latent magnetic image formed of force vectors extending with generally uniform lengths generally parallel with the facial expanse adjacent the perimeter of the image when the same is viewed normal to the plane of the expanse and which extend with increased angularity with respect to the facial expanse plane with distance inwardly from the image's perimeter, the length of such vectors extending parallel with the facial expanse plane being generally effectively equal to the cross-sectional dimensions of fines in such population, positioning the facial expanse containing the image sufficiently close to a mass of such particles thereby to draw particles magnetically to the latent image, and by said positioning and drawing, selectively capturing particles on the facial expanse extending over the latent image, with fines tending to predominate adjacent the latent image perimeter.

3. A method of producing a controlled-distribution, toned magnetic image unit in a plane-like magnetic-image-storage medium having a magnetizable facial expanse using magnetically attractable toner particles having differing sizes described by a range of sizes, said method comprising creating in such a facial expanse a latent magnetic image having a generally circular configuration characterized by radially extending perimetral force vectors which generally lie in the plane of the expanse, and by oblique, central force vectors extending at angles relative to the expanse, decorating the latent image with a mass of such particles, and by said decorating, and utilizing the forces associated with the radial and oblique vectors, capturing toner particles on the facial expanse extending over the latent image to produce a captured-toner image with the sizes of the captured particles tending to increase with the position of the particles radially inwardly from the latent image perimeter.

4. A method of producing a controlled-distribution, toned magnetic image unit in a planar-like magnetic-image-storage medium having an anisotropic magnetizable facial expanse characterized by a predominant direction of magnetization in the plane of the facial expanse, using magnetically attractable toner particles having differing sizes described by a range of sizes, including, at one end of the range, fines, said method comprising creating in such a facial expanse a latent magnetic image having a generally circular configuration characterized by radially extending perimetral force vectors which generally lie in the plane of the expanse, the effective length of the vectors being generally equal to the width of such fines, decorating the latent image with a mass of such particles, and by said decorating, and utilizing the forces associated with the radial vectors, capturing toner particles on the facial expanse extending over the latent image to produce a captured-toner image with the captured particles associated with the perimetral force vectors tending to be fines.

5. A method of producing a controlled-distribution, toned magnetic image unit in a magnetic image-storage medium having a magnetizable facial expanse using magnetically attractable toner particles having differing sizes described by a range of sizes, including at one end of the range, fines, and at the opposite end of the range, course particles, said method comprising creating in such a facial expanse a latent magnetic image having a generally circular configuration characterized by radially extending perimetral force vectors which generally lie in the plane of the expanse, and by oblique, central force vectors extending at angles relative to the expanse, decorating the latent image with a mass of such particles, and by said decorating, and utilizing the forces associated with the radial and oblique vectors, capturing toner particles on the facial expanse extending over the latent image to produce a captured-toner image, wherein the toner particle distribution, progressing radially inwardly from the perimeter of the captured-toner image, ranges generally from fines to course particles.

* * * * *